United States Patent [19]

Kriz

[11] Patent Number: 4,737,752

[45] Date of Patent: Apr. 12, 1988

[54] OSCILLOSCOPE DEFLECTION YOKE WITH HEAT DISSIPATION MEANS

[75] Inventor: J. Stanley Kriz, Fairfax, Va.

[73] Assignee: Megascan Technology, Inc., Gibsonia, Pa.

[21] Appl. No.: 895,207

[22] Filed: Aug. 11, 1986

[51] Int. Cl.[4] ..... H01F 7/00

[52] U.S. Cl. ..... 335/210; 335/217; 313/11; 313/46

[58] Field of Search ..... 335/210, 211, 213, 214, 335/217, 300; 313/11, 46, 430, 431

[56] References Cited

U.S. PATENT DOCUMENTS

| | | | |
|---|---|---|---|
| 3,573,525 | 4/1971 | Fuse | 335/217 X |
| 3,831,051 | 8/1974 | Ohgoshi et al. | 335/217 X |
| 4,549,042 | 10/1985 | Akiba et al. | 174/114 R |

FOREIGN PATENT DOCUMENTS

| | | | |
|---|---|---|---|
| 716216 | 8/1965 | Canada | 335/217 |

*Primary Examiner*—George Harris
*Attorney, Agent, or Firm*—Weingarten, Schurgin, Gagnebin & Hayes

[57] ABSTRACT

A high-performance deflection yoke providing deflection of an electron beam in a CRT at high rates at high deflection angles. The high-performance deflection yoke includes a heat sink contacting the deflection yoke coils to remove the heat produced in the deflection yoke due to core losses and heat produced in the deflection coils due to resistive losses. The heat sink minimizes induced eddy currents and comprises fine wire elements, interwoven and/or in juxtaposition with the deflection coils, wherein the heat created within and picked up by the deflection coils is transferred to the heat sink for dissipation. By minimizing power lost in the heat sink due to inductive heating of the metallic components thereof, the heat sink according to the present invention provides a high-performance deflection yoke having low inductance, high power performance not heretofore practically realizable.

7 Claims, 2 Drawing Sheets

FIG 3
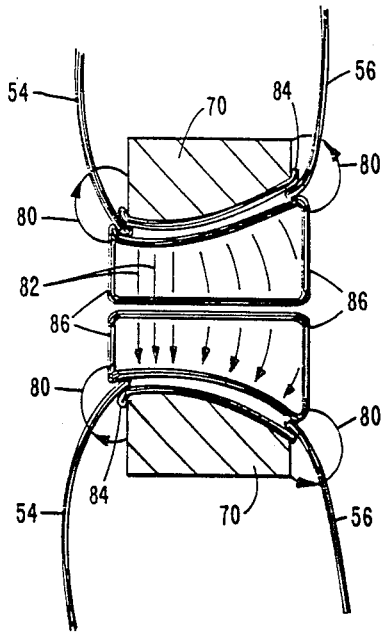
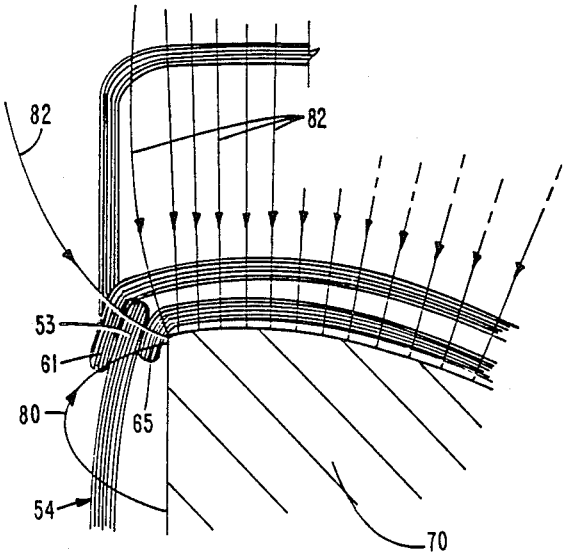
FIG 4

OSCILLOSCOPE DEFLECTION YOKE WITH HEAT DISSIPATION MEANS

FIELD OF THE INVENTION

The present invention relates to deflection yokes and, in particular, to deflection yokes including heat dissipation elements.

BACKGROUND OF THE INVENTION

High-performance raster scan CRT displays require high resolution rasters. In order to provide a high resolution raster display, the beam must be deflected rapidly across the screen of the CRT. As the speed requirement increases, the resistive losses of the deflecton coils increase because of "skin effect." This increase in loss can be minimized, but not eliminated, by the use of Litzendraht (litz) wire in these coils. Moreover, as the frequencies increase, the deflection yoke core, typically a powdered ferrite material, itself begins to heat up due to the material loss at high energy and high frequency.

Previous attempts to improve deflection yoke performance in CRT displays have included elements to sense the temperature of the deflection yoke and compensate or adjust the deflection circuit in response thereto. However, since this does not reduce the temperature of the deflection yoke, this technique provides no improvement on the ultimate power which may be provided to the deflection yoke.

Other more drastic techniques evade the problem by scanning with as many as eight separate controlled electron beam paths, reducing the number of scan lines and therefore scan deflection rate. However, this technique incurs an extreme economic penalty and redundant CRT electron gun driving and data separation circuitry.

Therefore, the present state of the art fails to provide any techniques for reducing the temperature of the deflection yoke, and further fails to appreciate the problems underlying the heat buildup in the deflection yoke.

SUMMARY OF THE INVENTION

A high-performance deflection yoke according to the present invention includes a heat sink comprising a low loss, low eddy current wire heat sink element interposed between the axial end portions of the horizontal and vertical deflection coils, extending radially outward from the deflection yoke. The heat sink comprises multiple conductor wire elements of a good heat conducting material, such as copper litz wire, comprising a plurality of smaller wires, each insulated one from another to inhibit the production of eddy currents in the heat sink itself. Moreover, the deflection yoke core itself is also cooled. As the deflection coils are cooled, the deflection coils, typically copper, transfer the heat from the deflection yoke core material to the heat sink. As a result, the deflection yoke according to the present invention provides extended high-performance operation not previously realizable in the art, thus permitting the realization of high-performance CRT displays not previously avialable.

BRIEF DESCRIPTION OF THE DRAWING

These and other features according to the present invention will be better understood by reading the following detailed description of the drawing, taken together with the drawing wherein:

FIG. 3 is a cross-sectional diagram of the deflection yoke of FIG. 2 showing deflection and leakage fields external to the deflection yoke; and FIG. 4 shows an expansion of the field shown in FIG. 3.

DETAILED DESCRIPTION OF THE PRESENT INVENTION

Figure 1:
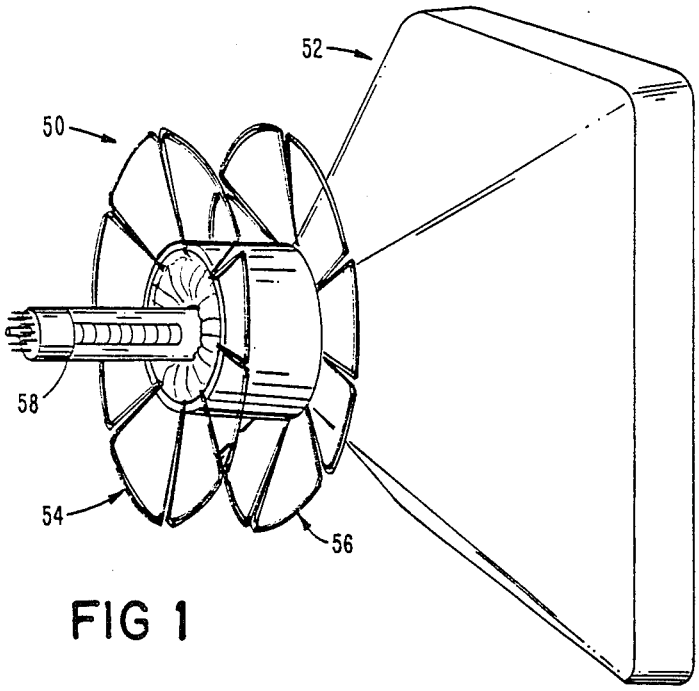
FIG. 1 is a rear perspective view of the deflection yoke according to one embodiment of the present invention as mounted on the typical CRT.

The perspective view of FIG. 1 shows the deflection yoke 50 according to one embodiment of the present invention installed on the rear of a CRT 52, and includes low eddy current heat sinks 54 and 56. The heat sinks 54 and 56 extend radially outward from the neck 58 of the CRt 52 and are spaced apart to provide an opportunity for air flow therethrough to remove the heat of the heat sinks 54 and 56. The yoke 50 is shown in exploded view in FIG. 2 wherein the horizontal deflection coils 60 and 62 are surrounded by the vertical deflection coils 64 and 66 when seated in the slots 68 of the deflection yoke core 70. The heat sinks 54 and 56 comprise overlapped, staggered windings 55 and 57 which typically provide a mechanically and thermally continuous center ring (51, 53) which is retained by the deflection windings 60–66. The heat sinks 54 and 56 typically are retained on the outside axial end portions 65, 67 of the vertical coils 64, 66 and overlapped by the axial end portions 61 and 63 of the horizontal coils 60, 62. The thermal conduction between the deflection windings and the heat sinks 54 and 56 may be further enhanced by securably fastening the axial end portions of the deflection windings 60, 62 and 64, 66 more tightly about the inner portions 51, 53 of the heat sinks 54 and 56. The heat sinks 54 and 56 include a plurality of fine wires and typically have unconnected ends 59 so as to provide an open circuit loop.

Figure 2:
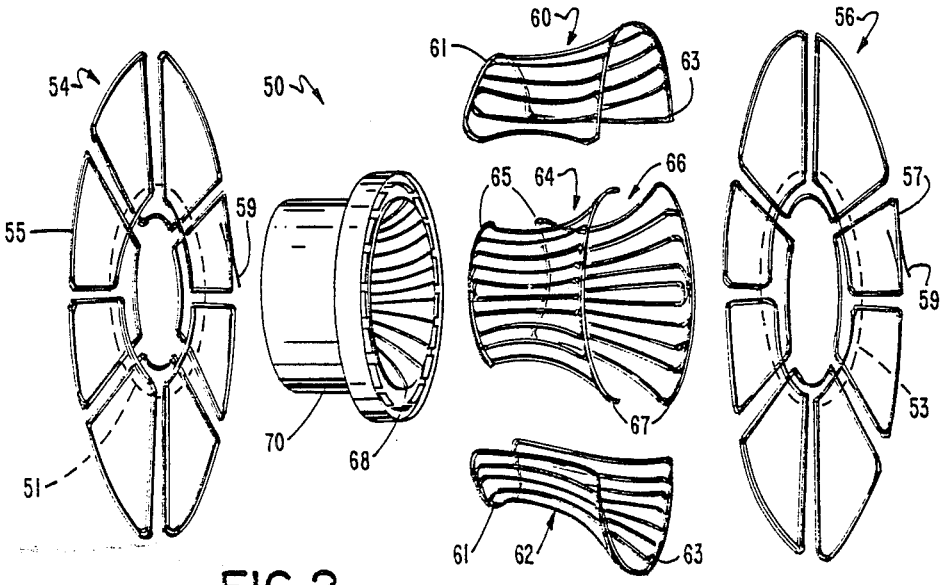
FIG. 2 is an exploded view of a deflection yoke according to the embodiment of FIG. 1.

The deflection yoke provided by the structure according to FIG. 2 removes the heat from the deflection coils to the heat sinks 54 and 56. Moreover, the heat produced by the deflection yoke 70 core material itself is removed by the heat or thermal conduction of the deflection coils themselves, wherein heat is transferred to the thermal sink radiators 54 and 56.

To further appreciate the present invention, the B-field pattern of FIG. 3 displays the leakage fields 80 and the deflection field 82 of the deflection yoke 50, shown in cross-section. FIG. 4 shows leakage field 80 in detail and part of deflection field 82 cutting through heat sink 54 and thereby potentially inducing eddy currents. The forward heat sink 56 and rear heat sink 54 are shown and retained between orthogonal axis deflection coils 84 and 86 at their axial end portions. It is appreciated that heat may be extracted by inserting a heat-conducting element in the manner shown in FIG. 3. However, the outward-extending magnetic fields 80 and 82, typically comprising a high frequency, alternating field, would induce significant eddy currents in solid heat sinks if substituted for the low eddy current heat sinks 54 and 56 of the present invention. Furthermore, it is also appreciated that other embodiments of the present invention are envisioned which are thermally coupled in other ways to the deflection yoke 70 and the deflection coils 84 and 86 according to the present invention. It is therefore believed that such future alternate embodiments, such as extending the heat sinks 54 and 56 into the inner portions of the yoke to coexist with the deflection windings, will work optimally when the magnetic field patterns are observed and eddy current losses therein are minimized as suggested according to the present invention.

Therefore, these and other embodiments, substitutions and modifications made by one skilled in the art are considered to be within the scope of the present invention, which is not to be limited except by the claims which follow:

What is claimed is:

1. A high-performance deflection yoke comprising:

a deflection winding; and heat sink means retained in contact with said deflection winding and having at least one heat conductive element extending away from said deflection winding, for transferring heat generated by said deflection winding away from said deflection winding.

2. The high performance deflection yoke of claim 1 further comprising a core retaining said deflection winding.

3. The high-performance deflection yoke of claim 1 wherein said heat sink comprises a low eddy current heat sink.

4. The high-performance deflection yoke of claim 3, wherein said low eddy current heat sink means comprises litz wire.

5. The high-performance deflection yoke of claim 3, wherein said low eddy current heat sink comprises wire elements interwoven within said deflection winding.

6. The high-performance deflection yoke of claim 3, wherein said low eddy current heat sink is juxtaposed to at least a portion of said deflection winding.

7. The high-performance deflection yoke of claim 6 comprising a plurality of deflection windings, wherein said low eddy current heat sink is interposed between at least a portion of a plurality of deflection windings.

* * * * *